US005928026A

United States Patent [19]

Hsu

[11] Patent Number: 5,928,026

[45] Date of Patent: Jul. 27, 1999

[54] FLOOR LAMP PLUG DEVICE

[75] Inventor: Keen Hsu, Taichung, Taiwan

[73] Assignee: Bright Yin Huey Co., Ltd, Taichung, Taiwan

[21] Appl. No.: 08/948,178

[22] Filed: Oct. 9, 1997

[51] Int. Cl.[6] ..... H01R 4/24

[52] U.S. Cl. ..... 439/413

[58] Field of Search ..... 439/411, 412, 439/413, 414, 419, 403

[56] References Cited

U.S. PATENT DOCUMENTS

| | | | |
|---|---|---|---|
| 2,700,142 | 1/1955 | Benander | 439/413 |
| 2,742,549 | 4/1956 | Peters | 439/412 |
| 2,758,280 | 8/1956 | More | 439/412 |
| 3,397,379 | 8/1968 | Puig | 439/414 |
| 5,398,180 | 3/1995 | Lee | 439/414 |

*Primary Examiner*—Steven L. Stephan
*Assistant Examiner*—Brian J. Biggi
*Attorney, Agent, or Firm*—Peterson, Wicks Nemer & Kamrath, PA.

[57] ABSTRACT

A floor lamp plug device has a cone-shaped body an annular body disposed on the cone-shaped body, a hollow disk, and a hollow cover. The hollow cover has an inner thread, an annular center flange, and a center hole. The hollow disk has a round hole two opposite protruded flanges, and each protruded flange having a channel and a slot. The annular body has a hollow interior receiving the hollow disk, an outer thread engaging with the inner thread two opposite notches matching the protruded flanges, and a recess. A branch wire set has a first wire and a second wire. The branch wire s et passes through the round hole. Each of the first wire and the second wire are inserted through the respective channel. A main wire set is inserted through the recess. Two conductive plates are inserted in the slots Each conductive plate has a tip end penetrating the branch wire set and a tooth end penetrating the main wire set.

3 Claims, 4 Drawing Sheets

FLOOR LAMP PLUG DEVICE

BACKGROUND OF THE INVENTION

The present invention relates to a floor lamp plug device. More particularly, the present invention relates to a floor lamp plug device which can be inserted in a ground quickly.

Referring to FIG. 1, a conventional floor lamp plug device comprises an inner threaded hole 11, a through hole 12 communicating with the inner threaded hole 11, a branch wire 2 passing through the inner threaded hole 11 and the through hole 12, and the branch wire 2 having a connection end A connected to a main wire 3. Since the conventional floor lamp plug device is made of iron, the device will be rusted after a long period of usage. Furthermore, the connection end A of the branch wire 2 is disposed out of the conventional floor lamp plug device. Therefore, it is very dangerous to touch the connection end A during raining .

SUMMARY OF THE INVENTION

An object of the present invention is to provide a floor lamp device which can be inserted in a ground quickly.

Another object of the present invention is to provide a floor lamp device which can protect the wires from an electrical leakage.

Accordingly, a floor lamp plug device comprises a cone-shaped body, an annular body disposed on the cone-shaped body, a hollow disk inserted in the annular body, and a hollow cover covering the annular body. The hollow cover has an inner thread, an annular center flange, and a center hole defined by the annular center flange. The hollow disk has a round hole, two opposite protruded flanges, and each protruded flange having a channel and a slot communicating with the channel. The annular body has a hollow interior receiving the hollow disk, an outer thread engaging with the inner thread, two opposite notches matching the protruded flanges, and a recess communicating with the notches. A branch wire set has a first wire and a second wire. The branch wire set passes through the round hole. Each of the first wire and the second wire are inserted through the respective channel. A main wire set is inserted through the recess. Two conductive plates are inserted in the slots. Each conductive plate has a tip end penetrating the branch wire set and a tooth end penetrating the main wire set. Each tooth and has two grooves. Each protruded flange engages with the respective notch.

DETAILED DESCRIPTION OF THE INVENTION

Figure 1:
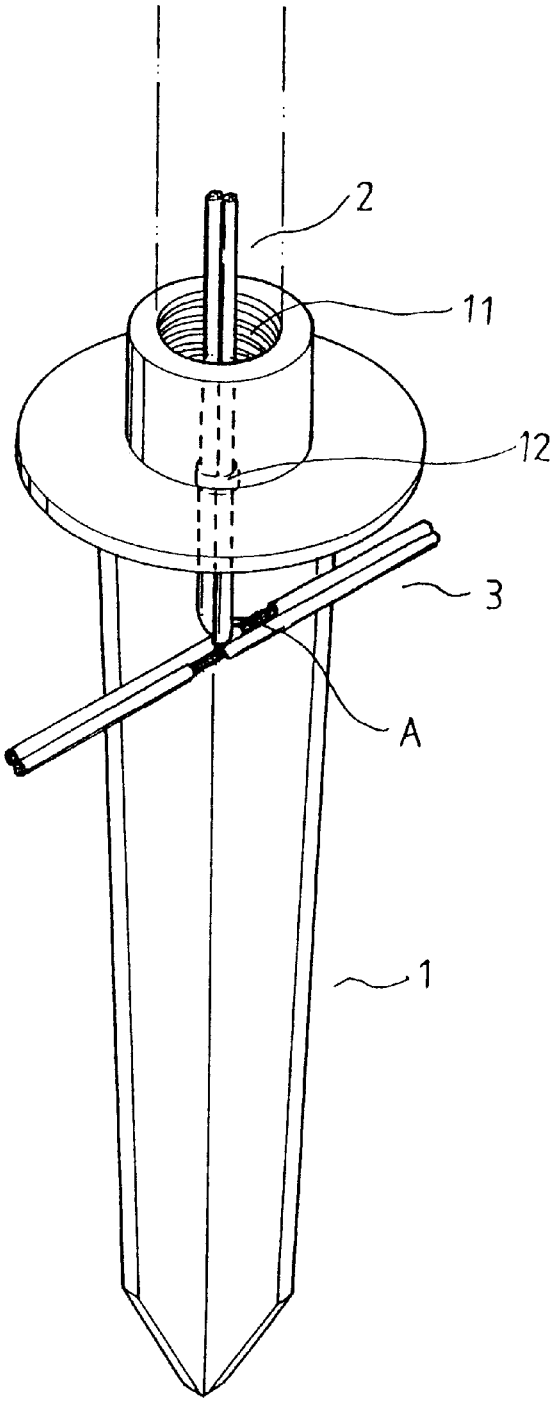
FIG. 1 PRIOR ART
FIG. 1 is a perspective view of a floor lamp plug device of the prior art.
Figure 2:
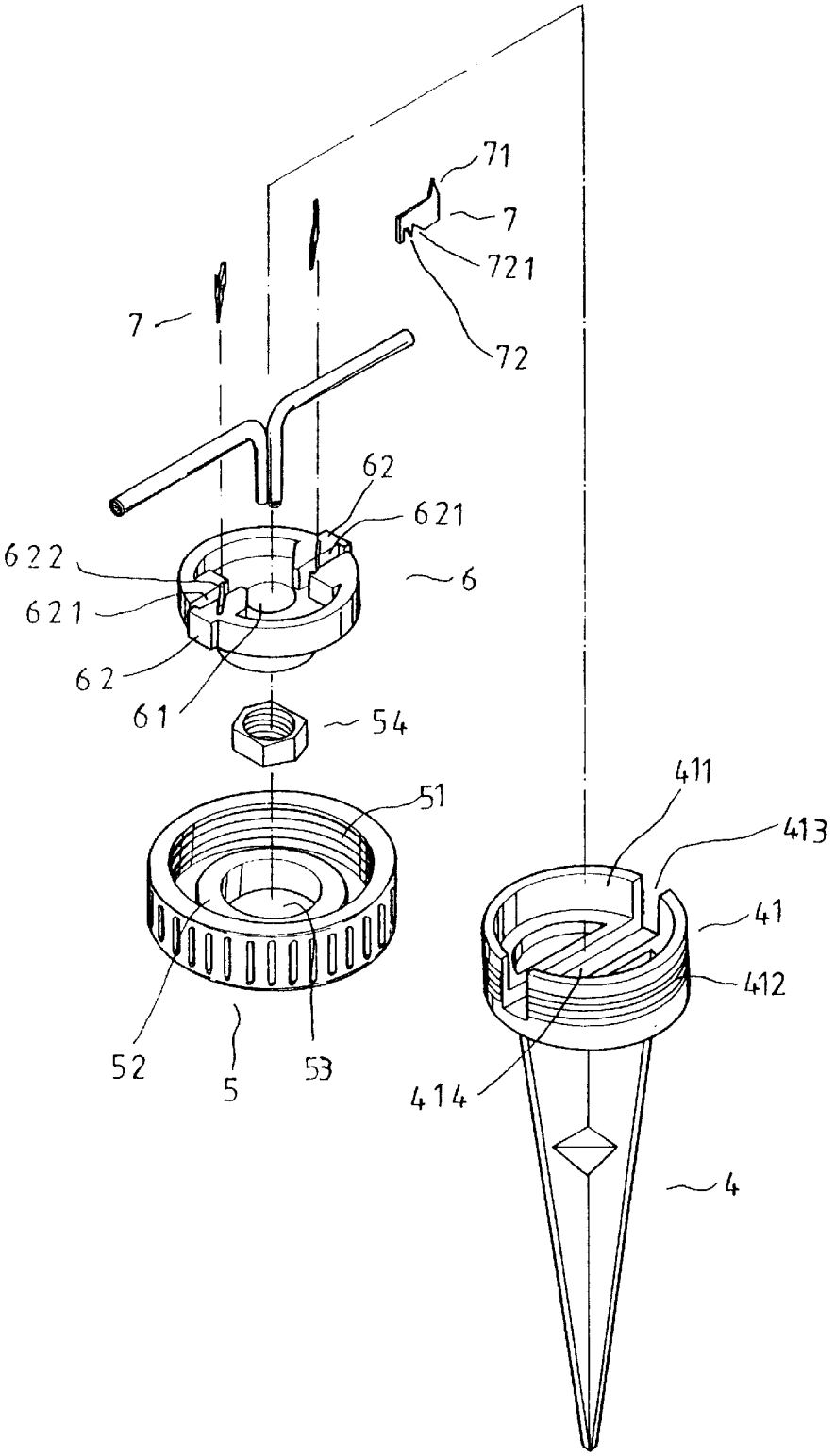
FIG. 2 is a perspective exploded view of a floor lamp plug device of a preferred embodiment in accordance with the present invention.
Figure 3:
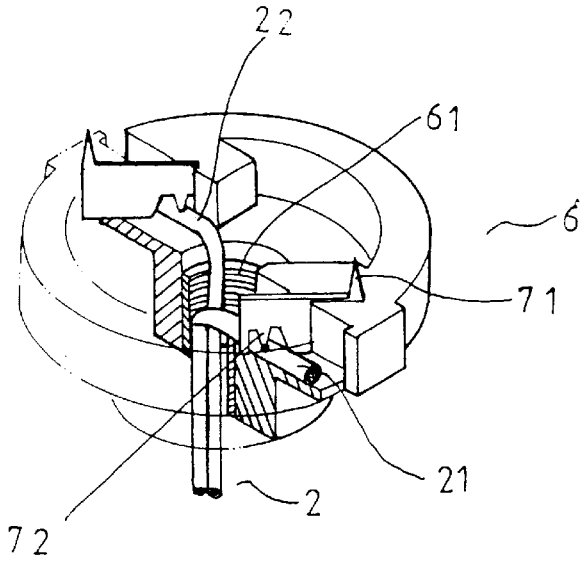
FIG. 3 is a partially sectional assembly view of a floor lamp plug device of a preferred embodiment in accordance with the present invention.
Figure 4:
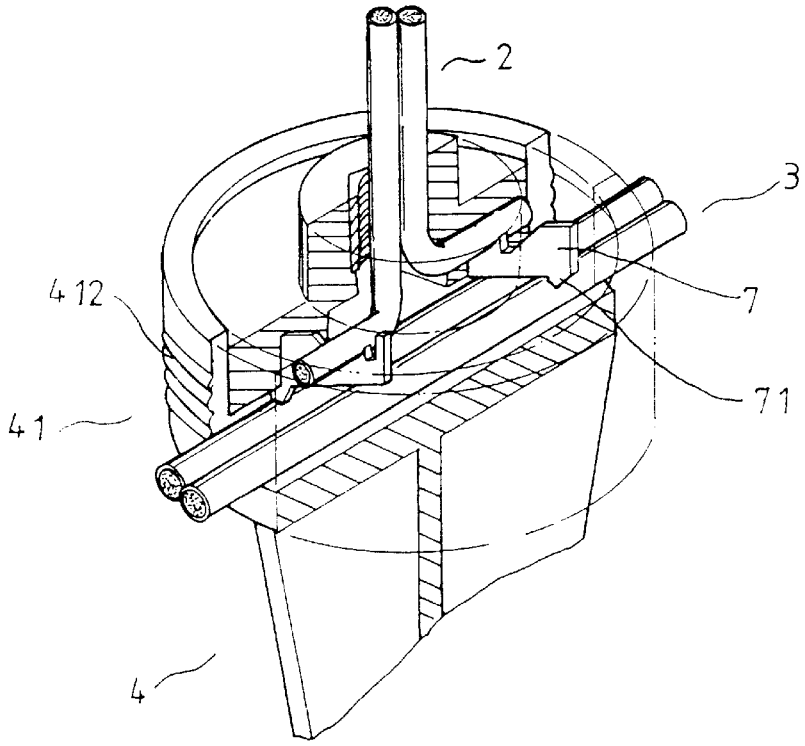
FIG. 4 is another partially sectional assembly view of a floor lamp plug device of a preferred embodiment in accordance with the present invention.
Figure 5:
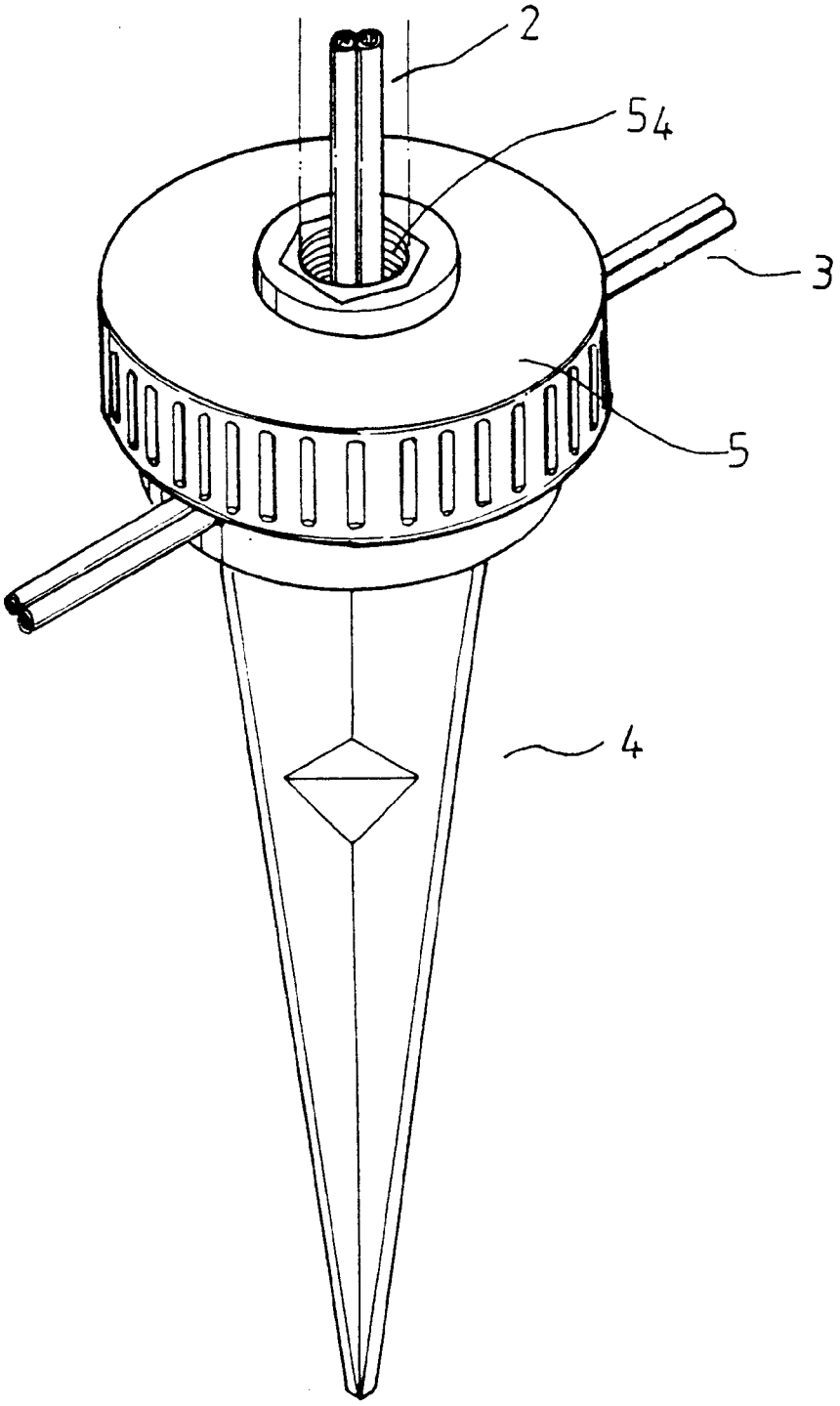
FIG. 5 is a perspective assembly view of a floor lamp plug device of a preferred embodiment in accordance with the present invention.

Referring to FIGS. 2 to 5 a floor lamp plug device comprises a cone-shaped body 4, an annular body 41 disposed on the cone-shaped body 4, a hollow disk 6 inserted in the annular body 41, and a hollow cover 5 covering the annular body 41.

The hollow cover 5 has an inner thread 51, an annular center flange 52, and a center hole 53 defined by the annular center flange 52.

The hollow disk 6 has a round hole 61, two opposite protruded flanges 62, and each protruded flange 62 having a channel 621 and a slot 622 communicating with the channel 621.

The annular body 41 has a hollow interior 411 receiving the hollow disk 6, an outer thread 412 engaging with the inner thread 51, two opposite notches 413 matching the protruded flanges 62, and a recess 414 communicating with the notches 413.

A branch wire set 2 has a first wire 21 and a second wire 22. The branch wire set 2 passes through the round hole 61. Each of the first wire 21 and the second wire 22 are inserted through the respective channel 621. A main wire set 3 is inserted through the recess 414.

Two conductive plates 7 are inserted in the slots 622. Each conductive plate 7 has a tip end 71 penetrating the branch wire set 2 and a tooth end 72 penetrating the main wire set 3. Each tooth end 72 has two grooves 721.

Each protruded flange 62 engages with the respective notch 413. A nut 54 is inserted in the center hole 53.

The invention is not limited to the above embodiment but various modification thereof may be made. Further, various changes in form and detail may be made without departing from the scope of the invention.

I claim:

1. A floor lamp plug device comprises:

a cone-shaped body and an annular body disposed on the cone-shaped body, a hollow disk inserted in the annular body, a hollow cover covering the annular body, the hollow cover having an inner thread, an annular center flange, and a center hole defined by the annular center flange, the hollow disk having a round hole, two opposite protruded flanges, and each of the protruded flanges having a channel and a slot communicating with the channel, the annular body having a hollow interior receiving the hollow disk, an outer thread engaging with the inner thread, two opposite notches matching the protruded flanges, and a recess communicating with the notches, a branch wire set having a first wire and a second wire, the branch wire set passing through the round hole, each of the first wire and the second wire inserted through the respective channel, a main wire set inserted through the recess, two conductive plates inserted in the slots, each conductive plate having a tip end penetrating the branch wire set and a tooth end penetrating the main wire set, and each of the protruded flanges engaging with the respective notch.

2. A floor lamp plug device as claimed in claim 1, wherein a nut is inserted in the center hole.

3. A floor lamp plug device as claimed in claim 1, wherein each said tooth and has two grooves.

* * * * *